United States Patent [19]

Smith et al.

[11] 4,454,827

[45] Jun. 19, 1984

[54] IGNITION AND CONTROL SYSTEM FOR FRAGMENTED WOOD-TYPE FUEL FURNACES

[75] Inventors: Norman Smith; John G. Riley, both of Orono, Me.

[73] Assignee: The Board of Trustees of the University of Maine, Bangor, Me.

[21] Appl. No.: 356,973

[22] Filed: Mar. 11, 1982

[51] Int. Cl.[3] ..... F23G 7/00

[52] U.S. Cl. ..... 110/234; 110/102; 110/190; 110/101 C; 126/25 B

[58] Field of Search ..... 110/102, 190, 234, 101 C; 126/25 B

[56] References Cited

U.S. PATENT DOCUMENTS

| | | | |
|---|---|---|---|
| 2,154,787 | 4/1939 | Teeple | 110/101 C |
| 2,176,009 | 10/1939 | Lange | 110/190 |
| 2,192,732 | 3/1940 | Johnson | 126/25 B |
| 2,228,751 | 1/1941 | Bros | 110/102 |
| 2,385,811 | 10/1945 | Hotchkiss | 110/101 C |
| 3,903,814 | 9/1975 | Altekruse | 110/101 C X |
| 4.027,602 | 6/1977 | Mott | 110/234 X |

FOREIGN PATENT DOCUMENTS

| | | | |
|---|---|---|---|
| 2625488 | 8/1977 | Fed. Rep. of Germany | 126/25 B |

*Primary Examiner*—Henry C. Yuen

*Attorney, Agent, or Firm*—Daniel H. Kane, Jr.

[57] ABSTRACT

A furnace system for automatic, continuous and efficient burning of fragmented wood-type fuel incorporates a wood-type fuel combustion chamber, a fragmented wood-type fuel feeder or conveyor for trickle feeding fuel into the chamber at selected uniform rates, a heat exchanger or heat exchange plenum, igniter for igniting the fuel fragments supported in the combustion chamber, a flame sensor mounted relative to the combustion chamber for sensing the presence of flames from fuel supported in the combustion chamber, one or more blowers providing forced air or forced draft, and a control circuit for controlling and sequencing operation of the elements for the furnace system and for operatively coupling the flame sensor and igniter for switching off the igniter upon sensing of flames from the wood-type fuel. An electric igniter is disclosed having a heating element for achieving flash point temperatures of fuel to be ignited, a shroud enclosing the heating element and communicating with the combustion chamber adjacent the fuel at a downwardly directed angle and a blower at the other end of the shroud for delivering air over the heating element. Two flame sensors are provided, for sensing the presence of flames from above and from the side.

22 Claims, 8 Drawing Figures

IGNITION AND CONTROL SYSTEM FOR FRAGMENTED WOOD-TYPE FUEL FURNACES

CROSS REFERENCE TO RELATED APPLICATIONS

This patent application is related to U.S. Pat. No. 4,312,278 issued Jan. 26, 1982, entitled Chip Wood Furnace and Furnace Retrofitting System, also assigned to the Board of Trustees of the University of Maine.

TECHNICAL FIELD

This invention relates to a new and improved system suitable for independent use and for retrofitting conventional central heating furnaces to permit controlled, continuous, and efficient combustion of fragmented wood-type fuels such as chipped, hogged, and pelletized wood, bark, wood waste, and logging residues. In particular, the invention relates to such wood-type furnace system provided with flame sensing automatic controls for either electrical ignition, oil burner ignition, or other conventional fuel ignition of the wood fuel.

BACKGROUND ART

In U.S. Pat. No. 4,312,278 referenced above, the furnace system is provided with a substitute for the oil burner gun or other conventional firing means, in the form of a wood-type fuel "gun" or burner for retrofitting and firing conventional furnaces or for use in a new independent furnace. For use in retrofitting, the conventional oil burner gun or other firing means is removed one stage from the furnace and may be fitted to the wood-type fuel burner "gun" for initiating combustion of wood-type fuel fragments such as wood chips, continuously fed into the wood fuel "gun". The wood-type fuel fragments or wood chips are "trickle" fed for combustion of the solid fuel at a rate to produce substantially the heat equivalent of the oil burner gun or other firing mechanism associated with the conventional furnace.

The foregoing patent application also described control circuitry for automatic control over the feeding and firing process and safety features which address the problems of continuous feeding and combustion of wood fuel fragments. By these expedients the disclosed invention permits combustion of wood in central heating furnaces with all the incidents and advantages of oil fired systems. A variety of automatic arrangements for safely feeding the fragments of wood-type fuel into the wood fuel "gun" and for safely burning the fuel in the combustion chamber are disclosed and the disclosure of this patent application is incorporated herein by reference.

Ignition of the wood fuel and solid fuel fragments in the furnace system of U.S. Pat. No. 4,312,278 is accomplished by means of an oil burner gun, motor and firing means received at the side of the wood fuel combustion chamber, generally positioned under a wood fuel supporting grate, and automatically controlled and operated to initiate wood fuel combustion. Once firing of the wood is established the oil burner gun is cut off and the furnace output is achieved solely by wood-type fuel combustion.

OBJECTS OF THE INVENTION

It is an object of the present invention to provide a new furnace control system for fragmented wood-type fuel furnaces based upon sensing the presence or absence of flame rather than upon sensing heat and suitable for use with electric ignition, oil burning ignition, and other forms of ignition for the wood-type fuel.

Another object of the invention is to effect even greater savings in the furnace operation by providing electrical ignition of the wood fuel fragments for initiating wood-type fuel combustion. By this expedient any use of oil or other conventional fuel in the operation of the furnace system may be eliminated.

A further object of the invention is to provide an independent wood-type fuel fired furnace system with electrical ignition or conventional fuel ignition and with fully automatic operation suitable for use as either a hot air furnace or as a hot water or steam boiler. The system may also be adapted for use as a domestic hot water heater, as a space heater, or a retrofit for a conventional wood stove.

DISCLOSURE OF INVENTION

In order to accomplish these results the present invention provides in one preferred embodiment a new furnace system for automatic, continuous and efficient burning of chipped, hogged, pelletized or other fragmented wood-type fuels. The furnace system incorporates a wood-type fuel combustion chamber, a fragmented wood-type fuel feeder or conveyor for trickle feeding fuel into chamber at selected uniform rates, a heat exchanger and heat exchange plenum, an igniter such as an electric igniter for igniting the fuel fragments supported in the combustion chamber, flame sensor mounted relative to the combustion chamber for sensing the presence of flames from fuel supported in the combustion chamber, one or more blowers providing forced air or induced draft, and a control circuit for controlling and sequencing operation of the elements of the furnace system and for operatively coupling the flame sensors and igniter for switching off the igniter upon sensing of flames from the wood-type fuel.

The wood-type fuel combustion chamber is formed by an enclosure of refractory material and may have an elongated afterburning passageway or a divider which partially separates a primary combustion section from an afterburner section. A combustion grate or other combustion surface is positioned in the primary combustion section for receiving fragments of wood-type fuel from the trickle feeder and for supporting the combusting fuel. The enclosure is formed with an opening above the combustion grate for gravity feed of fuel onto the grate. In the preferred form using electric ignition and a grate, the combustion chamber is formed with air inlets above and below the grate providing heated combustion air above the grate when the electric igniter is on and sustaining combustion air from below passing through the grate. The draft outlet is spaced from the grate in the afterburner section for venting products of combustion.

The wood-type fuel combustion chamber may assume a variety of configurations according to the invention. Thus, the firebox may be elongated in a vertical direction to provide the secondary combustion afterburning section in the form of an elongated flame-path or passageway in the vertical direction over the combustion grate or surface. The heat exchanger may be located vertically over a vertical flame path afterburner passageway in which case the fragmented fuel is introduced above the grate at an angle from the side. It has been found that a flame-path of at least one to two feet in length extending from the combustion surface with sufficient air affords substantially complete combustion. Thus, the total length from the grate or combustion surface to the end of the flame-path, whatever the configuration of the firebox, sufficient to contain the flame is desirable. The firebox may also be elongated in the horizontal direction to provide secondary combustion afterburning along a passageway extending in major part horizontally from the combustion grate or surface. As hereafter illustrated a divider may be incorporated between the primary combustion section of the firebox and the afterburning section affording an overall flame-path of for example at least one to two feet sufficient to contain and complete the flame before the combustion products are subjected to heat exchange in a heat exchange plenum or other heat exchange manifold.

In order to provide a flame-path or flame passageway of sufficient length, a flame tube adapter or coupling may be provided between the combustion chamber firebox and the heat exchanger or heat exchange plenum of the furnace. The flame tube adapter may be formed with selected lengths sufficient to afford substantially complete combustion of the exhaust gases while maintaining sufficient temperature to radiate heat into the heat exchange plenum. Where heat exchange occurs within the firebox itself as for example in a hot water or steam heating system the flame tube adapter or coupler is of course not required and instead the firebox itself is elongated to provide a passageway of sufficient length for substantially complete combustion of the gases prior to contact with the heat exchange surfaces in the firebox. This elongation may be in a vertical direction or a horizontal direction.

Furthermore, the fragmented wood-type fuel such as the wood chips may be supported on a grate or grill permitting underfire air as described in the aforementioned U.S. Pat. No. 4,312,278. Alternatively the fragmented wood-type fuel may be supported on a solid combustion surface mounted in the firebox with overfire air provided in the form of air tubes directing air directly into and over the combusting fuel. The solid surface may be mounted at the same location as the previously described grate, at the base of the chamber, or at an intermediate position. Furthermore, the solid combustion surface may be horizontal or it may be sloped. Provision is made for periodic ash cleanout or dumping. The configuration using a solid combustion surface is particularly applicable for burning fuel in a finely divided powdery form, e.g. sawdust.

According to the invention the electric igniter for igniting wood-type fuel supported on the grate or combustion surface is formed with a heating element such as for example a compound helix or other element configuration with parameters selected for achieving flash point temperatures of fuel to be ignited. A shroud encloses the heating element and communicates at one end with the combustion chamber above the grate or combustion surface adjacent the fuel supported on the grate. The open end of the shroud exposes the wood-type fuel supported on the grate to radiant heat from the heating element. A grid or protective mesh on the open end of the shroud may be included to prevent wood fuel from scattering into or against the heating element. Furthermore it is advantageous to direct the heating element and shroud onto the fuel at an angle of, for example, 35° above the horizontal. The downwardly directed attitude of the shroud permits radiating onto the surface of the fuel pile from above rather than the side. The furnace can operate longer without dumping the grate, and the protective mesh or grid on the shroud is no longer necessary. A blower is coupled to the other end of the shroud for delivering air over the heating element. A feature and advantage of the blower and heating element arrangement is that air delivered over the heating element cools the heating element thus increasing its life while delivering heated combustion air to the fuel, particularly during start-up.

According to another aspect of the invention at least one flame sensor is positioned or mounted relative to the combustion chamber for sensing the presence of flames from fuel supported on the combustion grate. The control circuit for controlling and sequencing the elements of the furnace operatively couples the flame sensor with the igniter for switching off the ignition elements upon sensing flames from the wood-type fuel. In the preferred embodiment at least two flame sensors are provided, a first flame sensor positioned relative to the wood-type fuel combustion chamber over the combustion grate for sensing the presence of flames from above the grate. The second flame sensor is positioned relative to the combustion chamber at the side of the chamber for sensing the presence of flames from the side in the event the feeding wood chips or other fuel blocks the line of sight of the first flame sensor. The first and second sensors are coupled in parallel in the control circuit so that either will be operative to shut off the electric igniter heating element in the event that flames are sensed by either.

A feature and advantage of the control circuit according to the present invention utilizing flame sensors or light sensors rather than heat sensors is that the control circuit is applicable either for electric ignition of the fragmented wood-type fuels or ignition by oil or other conventional fuel-firing means. In either event, sensing the flames or light provides rapid response in comparison with heat sensors previously used.

The control circuit for sequencing operation of the furnace includes a first timer which delays actuation of the igniter for a pre-determined time when electric ignition is used while sufficient fuel accumulates from the trickle feeder onto the combustion grate. A second timer turns off the electric igniter heating element in the event flames do not appear from the accumulated pile of fuel within a specified period of time. A variety of other safety features are incorporated into the logic of the control circuit and components of the furnace.

In particular the invention incorporates a solid fuel pilot concept for standby operation of fragmented wood-type fuel furnaces. According to this pilot concept, the furnace control system maintains sufficient coals on the grate or other combustion surface to ignite the fuel at any time without a cold start. To accomplish this an interval timer switch is connected in parallel with the aquastat or thermostat of the furnace system. When the thermostat is not calling for heat a timer switch overrides the off condition of the thermostat intermittently for short periods at predetermined intervals to feed sufficient fuel into the firebox to maintain a pilot fire. The flame sensors may be used to control the standby solid fuel pilot.

A feature and advantage of the present invention is that the new furnace system is adapted for utilizing and retrofitting conventional hot air, hot water, and steam boiler furnaces for example oil fired furnaces having conventional combustion chamber, heat exchanger and firing means. Thus, the present invention contemplates providing either an independent furnace system or a retrofitting furnace system for retrofitting conventional furnaces. In the latter event according to the invention the flame tube adaptor or coupler couples the wood-type fuel combustion chamber outlet into the combustion chamber and plenum of the conventional furnace to be retrofitted. In this respect, the conventional firing means of the conventional furnace may be removed and the flame tube adaptor substituted in its place. Alternatively, the wood-chip or fragmented wood-type fuel "gun" may be used to supplement or operate side-by-side with the conventional firing means. In either event, the retrofitting system of the present invention may be used with hot air furnaces and hot water and steam boilers, and with furnaces fired by either oil, coal, or other conventional fuels.

Of the various possible applications of the present invention a hot water or steam boiler furnace system is described with the conventional oil burner retained in place for back-up firing. In addition, a domestic hot water unit is also described. The elements of the invention are also applicable however to hot air furnaces and conventional furnaces of the type described in the above-mentioned U.S. Pat. No. 4,312.278.

The invention provides a new control system for wood-type fuel fired furnace systems based upon the sensing of the presence or absence of flames by sensing infra-red, ultra violet, or visible light energy rather than heat. According to this aspect of the system, the wood fuel igniter of whatever type, for example either an electric igniter, oil burner or other conventional fuel igniter, is controlled by flame sensors positioned relative to the wood-type fuel for determining whether or not ignition and combustion have been achieved.

Thus, integrally associated with the control system is at least one flame sensor and preferably two or more which are positioned relative to the combustion chamber for sensing the presence of radiant e-m energy from the wood-type fuel. A control circuit associated with the igniter couples the igniter and flame sensor for switching off the igniter upon sensing flames from the wood-type fuel. A plurality of flame sensors may be provided for sensing flame from different directions. A feature and advantage of the principle of flame sensing or radiation energy sensing is that it provides improved control of wood combustion, whatever igniter is used, be it an electric igniter, oil burner igniter, etc.

The invention also contemplates providing in itself a novel electric ignition for wood-fired or wood-type fuel fired combustion devices and combustion chambers. The electric igniter includes the heating element operatively formed for achieving flash point temperatures for the fuel to be ignited, and a shroud enclosing the heating element. The shroud is formed at one end to engage the combustion chamber adjacent to the wood fuel or other fragmented wood-type fuel supported in the combustion chamber. The shroud is open at this combustion chamber end to expose the fuel to radiant heat from the heating element. The igniter shroud is mounted at an angle above the horizontal directed downwardly toward the fuel for improved results. At the same time a blower coupled to the other end of the shroud delivers air over the heating element thereby cooling the heating element for prolonged life and delivering heated combustion air to the fuel at least during start-up. Preferably, this blower remains on during furnace system operation after the heating element turns off to protect and continually cool the heating element.

Other objects, features and advantages of the present invention will become apparent in the following specification and accompanying claims.

BEST MODE FOR CARRYING OUT THE INVENTION

Figure 1:
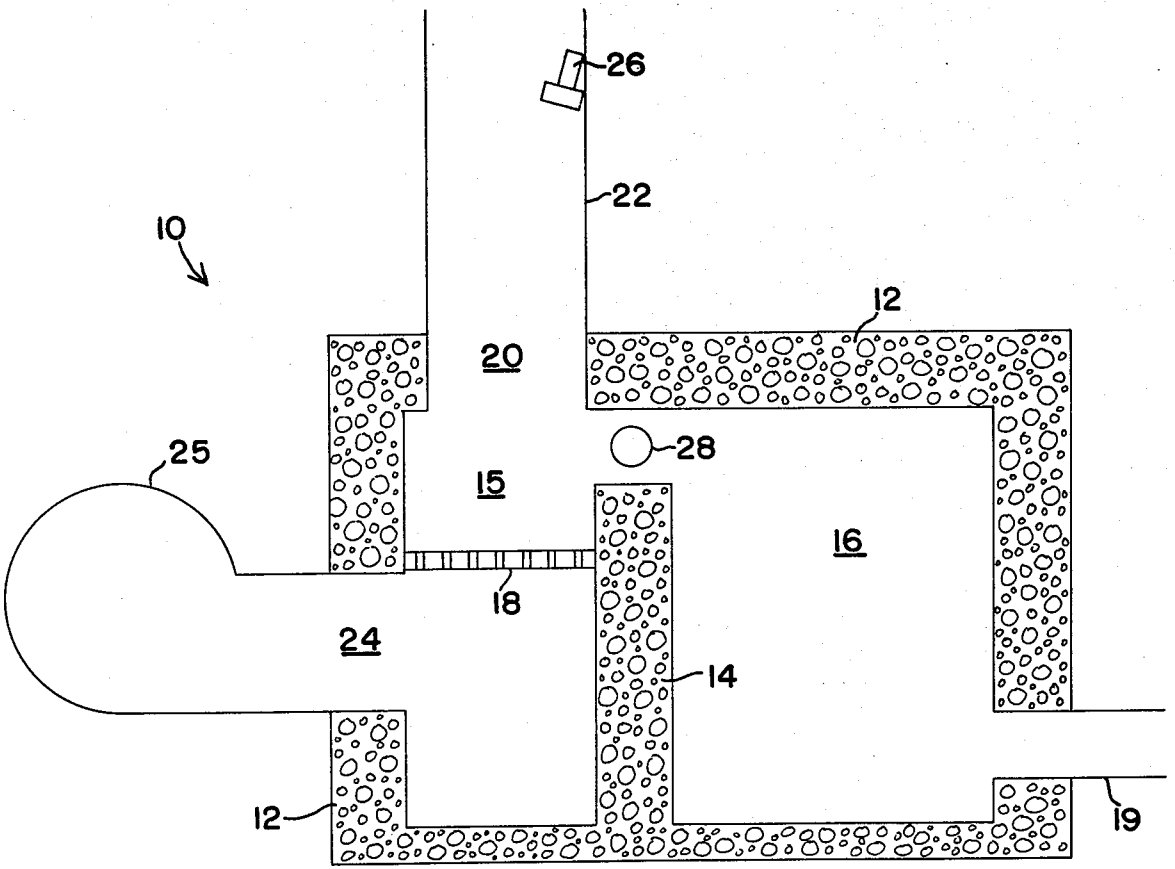
FIG. 1 is a side cross section of a wood chip fuel combustion chamber firebox with oil burner igniter as described in U.S. Pat. No. 4,312,278 and modified according to the present invention for flame sensor control.

The wood chip type fuel fired furnace combustion chamber 10 illustrated in FIG. 1 comprises a firebox enclosure 12 made of or lined with refractory insulating material. The refractory divider 14 generally divides the firebox into a primary combustion section 15 and an afterburner section 16 with flame path or combustion path of sufficient length from the fragmented wood type fuel supporting grate 18 to permit substantially complete combustion of the gases. Flame tube adapter 19 at the firebox outlet provides additional flame path or combustion path length to afford a composite combustion path of, for example, two feet (51 cm) or sufficient to contain the flame path.

The grate 18 is supported in the primary combustion chamber or section 15 and below the opening 20 formed at the top of the firebox 12, for gravity feed of fragmented wood-type fuel such as wood chips through a fuel drop tube 22 onto the combustion grate 18. The fuel drop tube 22 is coupled to an overhead wood chip fuel trickle feeder hereafter described with references to FIGS. 3 and 4 and also set forth in U.S. Pat. No. 4,312,278. A second inlet opening 24 is formed in the side of firebox 12 below the combustion grate 18 for accommodating the oil burner igniter 25 which is provided for igniting from below and through grate 18 wood chips received from the fuel drop tube 22 and supported on the grate. The oil burner may alternatively be mounted above the grate for ignition of chips on the grate without ignition flames passing through the grate from below. More complete description of the elements of firebox 10 enumerated so far can be found in the U.S. Pat. No. 4,312,278 referenced above.

According to the present invention a further dimension is added to the structure and function of the combustion chamber firebox of FIG. 1 by the addition of flame sensors 26 and 28. According to the invention a call for heat from the furnace system initiates trickle feeding of fragmented wood type fuels through fuel drop tube 22 onto the grate 18. Oil burner 25 is actuated along with a forced draft inducer blower in the smoke stack to which the flame tube coupler 19 is connected if forced draft is necessary. Oil burner 25 is positioned below the grate 18 to assure that the hot oil combustion gases pass through and ignite the fuel chips accumulated on grate 18. The space below grate 18 forms an ash pit which may be provided with a cleanout door in the wall of the firebox.

The present invention further provides flame sensors 26 and 28 which are light detecting cells such as for example cadmium sulfide or selenium cells. Flame sensor 26 is positioned in the fuel drop tube 22 or at the top of the drop tube 22 adjacent the fragmented wood-type fuel trickle feeder as hereafter described so that it is in the direct line of sight vertically over the grate 18 and chip wood fuel accumulated on the grate. Flame sensor 28 is positioned in the flame path down-stream from the grate in the line of sight across the flame path for example at the beginning of the afterburner section 16 of the firebox. Flame sensors 26 and 28 are coupled in parallel in the control circuit hereafter described to shut off the oil burner igniter 25 after either of the sensors detects the presence of a flame.

While flame sensor 26 is positioned in the direct line of sight of the fuel on grate 18, flame sensor 28 looks across the flame path down-stream. This dual sensing arrangement affords the advantage that combustion flames may be sensed even if the direct line of sight of sensor 26 is obscured by wood chips or other fragmented fuel falling in the drop tube 22. By reason of the parallel connection detection of flames of either of the sensors 26 or 28 will initiate the sequence shutting off oil burner igniter 25. Light energy detection by flame sensors 26 and 28 affords more rapid and reliable response to the condition of the wood chip type fuel than can be achieved by the heat sensors heretofore used.

The flame sensors 26 and 28 may be coupled into a control circuit for a variety of logic and control functions as hereafter described.

Figures 2, 2A:
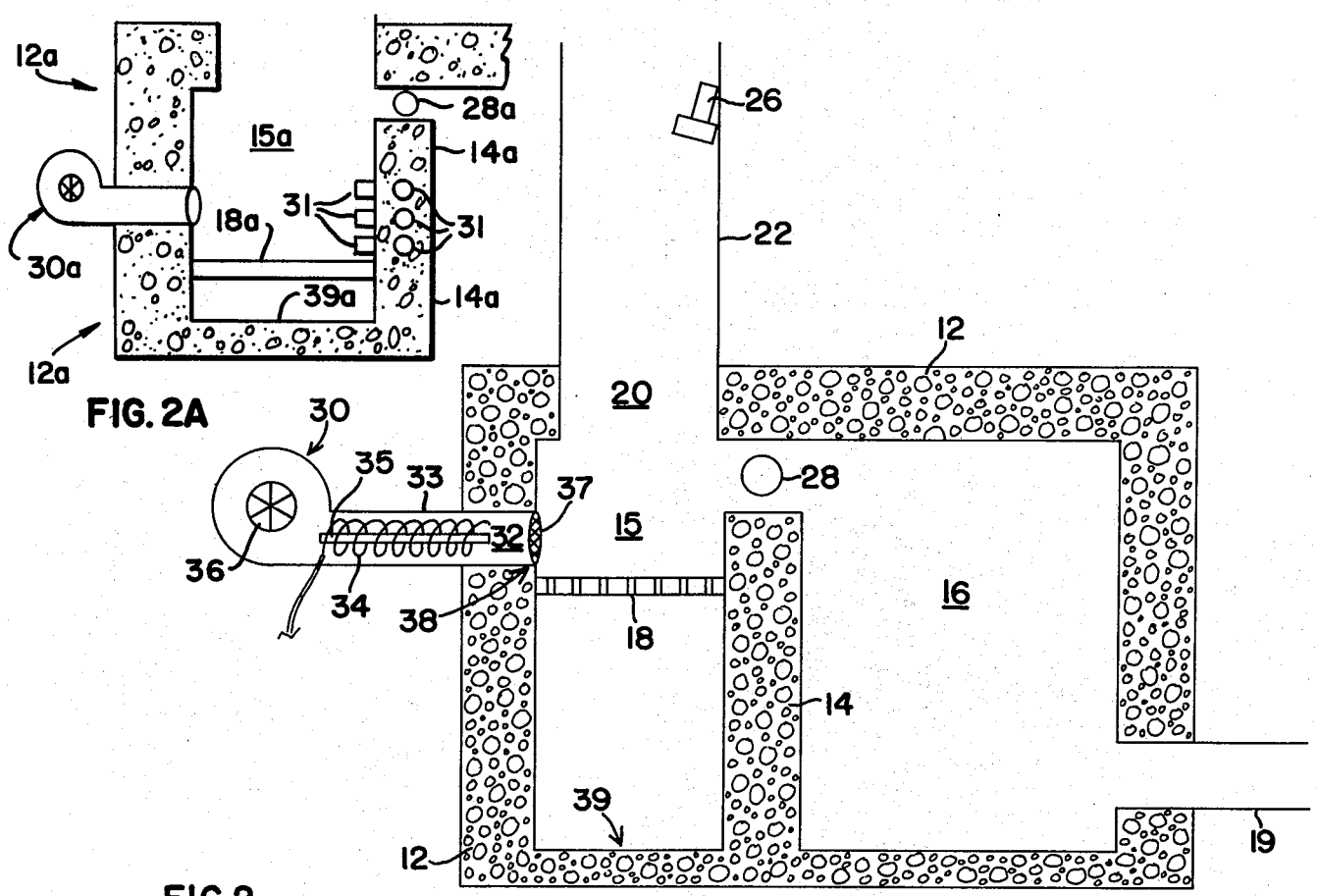
FIG. 2 is a side cross section of a wood chip type fuel combustion chamber and firebox with electric heat ignition of the wood chip type fuel in accordance with the present invention.
FIG. 2A is a fragmentary detailed side cross section of an alternative fuel combustion chamber and fire box configuration with electric ignition.

The combustion chamber elements of the electric ignition fragmented wood-type fuel fired furnace system are shown in FIG. 2, with elements corresponding to those of FIG. 1 designated by the same numerals. The chip wood type fuel trickle fed and accumulated on grate 18 in this firebox however is ignited by an electric igniter 30, positioned at an opening 32 in the firebox wall located above the grate 18. Electric igniter 30 includes a sheath 33 enclosing an electrical resistance heating element 34 which may be in the configuration for example of a double helix or any other appropriate heating element configuration generally mounted and supported within the sheath 33 on an insulating support 35. The heating element may be for example a 20 amp. element adequate to achieve the ignition flash point temperatures of the chip wood type fuel. A small fractional horsepower blower 36 is mounted to the outer end of sheath 33 for delivering forced air over heating element 34. The open end of the sheath 33 is securely coupled into the opening 32 in the wall of the firebox directly adjacent chip wood fuel accumulated on the grate 18. A grid 37 over the open end 38 of the sheath 33 prevents fuel fragments from scattering into the sheath and contacting the heating element 34.

When the thermostat calls for heat from the chip wood fired furnace system, the trickle feeder is actuated to deliver fuel for gravity feeding onto the combustion grate 18. After the adjustable delay interval of for example two minutes the 110 volt heating coil element 34 is actuated and the small blower 36 delivers forced air over the coil 34, cooling the coil and delivering preheated combustion air onto the fuel. Fuel ignition is effected by radiant heat directly from the heating element 34 which must be close enough to the fuel pile, for example two and one-half inches (6.25 cm.) to ignite the chips. Heated air passing over the heating element facilitates ignition and propagation of the flame while at the same time cooling and protecting the heating element. However it is radiant heat that ignites the chips and the air then propagates the flame.

A feature and advantage of the electric igniter 30 over the oil burner igniter 25 is the reduction in cost. In this example the 2300 watt igniter coil gives 1000° F. air and generally remains on for 20 to 40 seconds per ignition. At current rates the cost of operation of the electric igniter is approximately 15 ignition cycles per $0.01 as contrasted with the $0.01 per ignition cost of the oil burner igniter at current cost.

Figure 4:
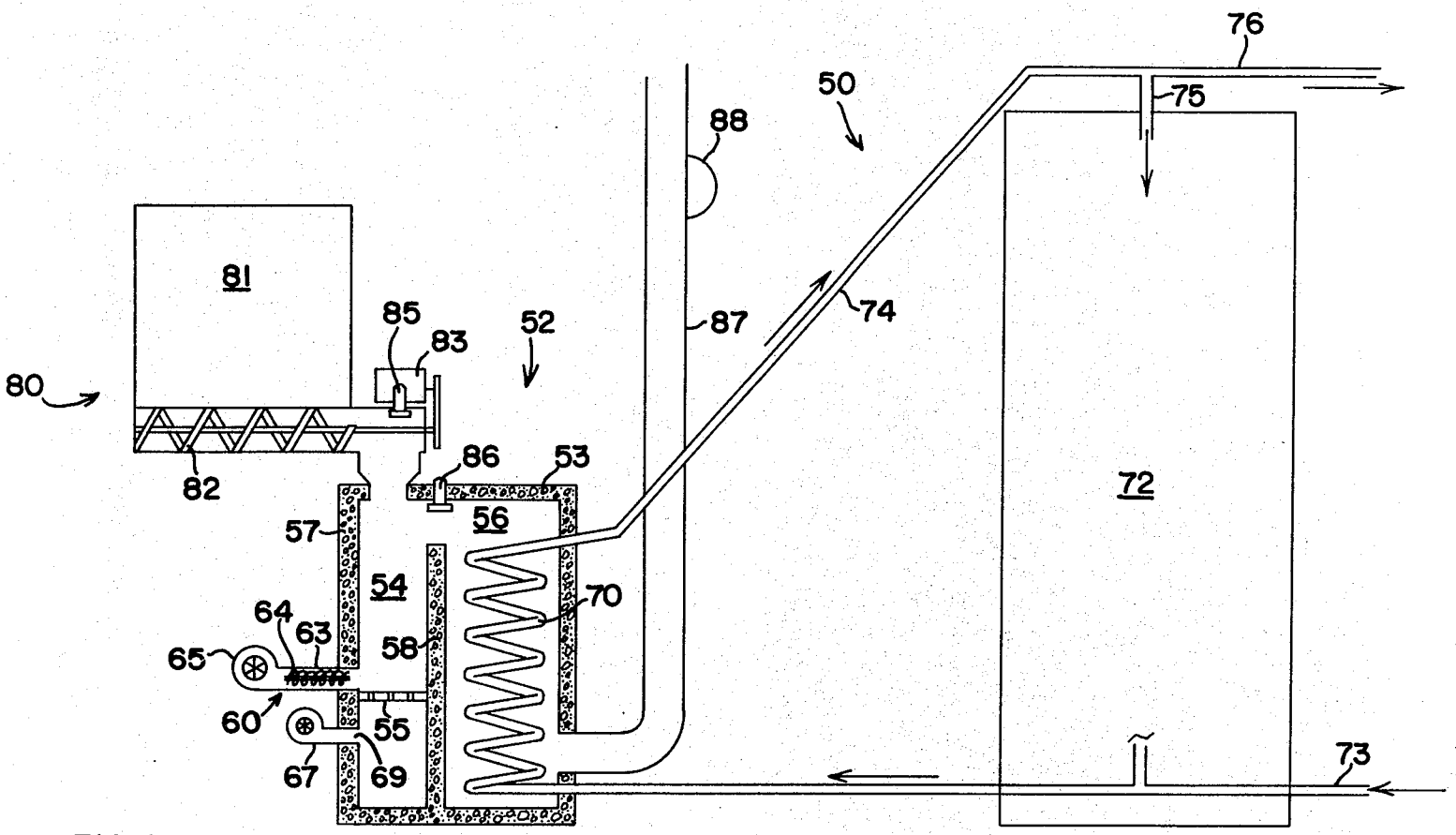
FIG. 4 is a diagrammatic view and partial cross section of a fragmented wood-type fuel fired domestic hot water unit according to the present invention.

The blower 36 of electric igniter 30 provides only a small fraction of the required combustion air and the remaining air may be admitted through openings in the firebox wall below the grate 18. Forced underfire air may also be provided by mounting a blower through an opening in the firebox wall below the grate 18 as illustrated in the example of FIG. 4.

Use of the electric igniter 30 which is mounted above the combustion grate or surface 18 permits another possible configuration for the firebox as illustrated in FIG. 2A. According to this alternative the combustion surface which need not be a perforated grate but may also be a solid surface 18*a* is positioned adjacent the base 39*a* of the primary combustion chamber section 15*a* of the firebox 12*a*. The electric igniter 30*a* is repositioned so that it is immediately adjacent fuel piled at the combustion surface 18*a*. The major portion and balance of combustion air is then provided by combustion tubes 31 formed in the wall 14*a* of the firebox 12*a* above the combustion surface 18*a*. Thus, in this configuration all of the combustion air is over fire air.

Figure 3:
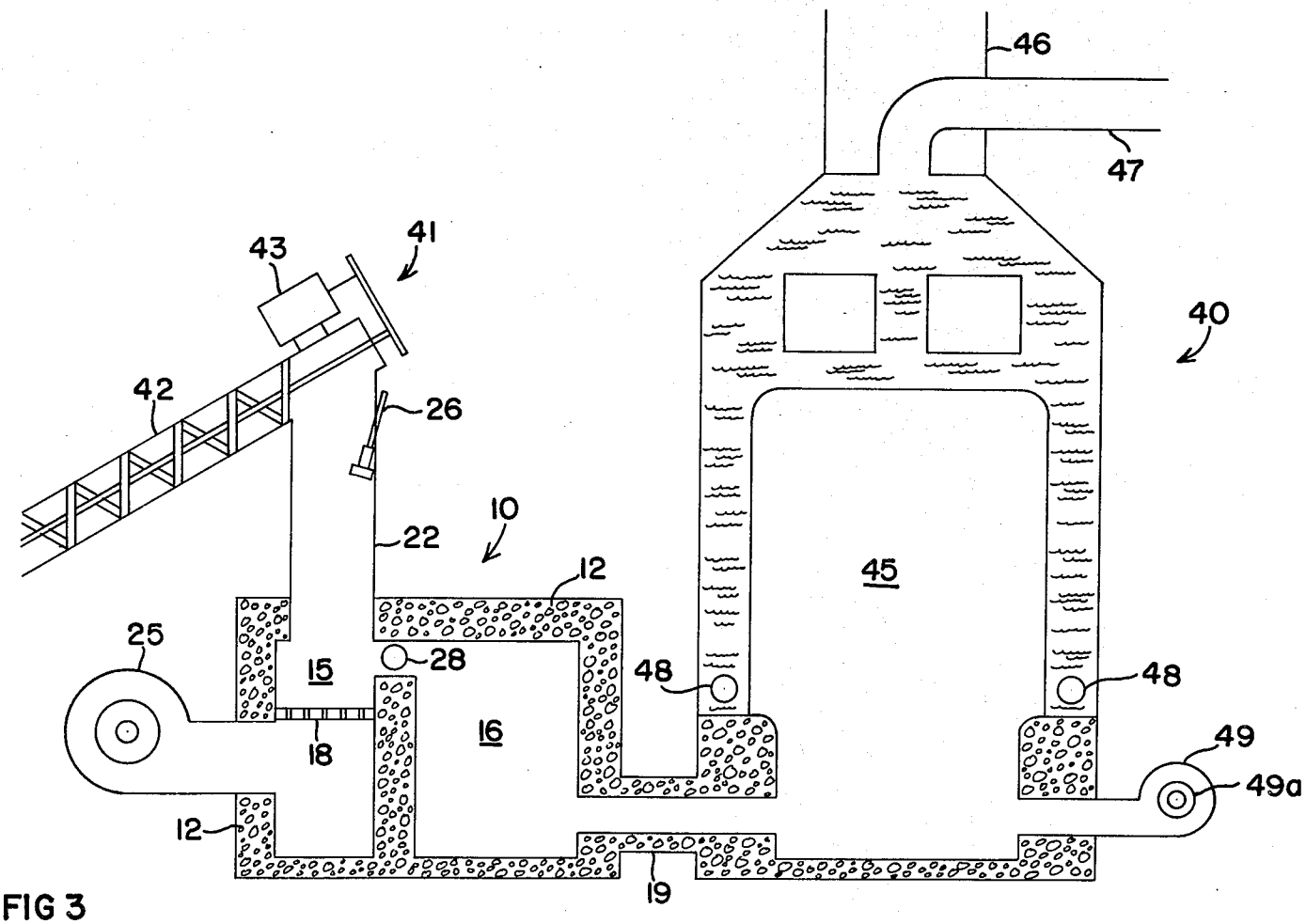
FIG. 3 is a diagrammatic side cross section of a fragmented wood-type fuel fired hot water or steam boiler furnace system according to the present invention.

A fragmented wood-type fuel fired hot water or steam boiler 40 incorporating the combustion chamber of FIG. 1 is illustrated in FIG. 3. The elements of the combustion chamber of FIG. 1 are similarly numbered. A chip wood feeder 41 for trickle feeding and gravity delivering wood chips to the grate 18 through fuel drop tube 22 is mounted over the combustion chamber 10 and includes a conveyor 42 and conveyor motor 43 for feeding and delivering wood chips or rather fuel fragments at a desired heat output rate. The flame tube coupler 19 delivers the hot end products of combustion into the heat exchange plenum 45 of the boiler 40. The combustion gases pass through the smoke pipe 46 from the boiler which may be fitted with a draft inducing blower if natural draft is not sufficient to deliver a pressure differential through the combustion chamber 10. The circulating water or steam flow from the water reservoir and heat exchange plenum of boiler 40 passes through outlet 47. Water returns to the boiler through inlets 48.

In the example of FIG. 3, the hot water or steam boiler 40 represents a conventional boiler retrofitted with the wood chip fired combustion chamber 10 operating in accordance with the description with reference to FIG. 1. The conventional oil burner 49 of boiler 40 has been retained in place for automatic back-up operation and for firing when the chip wood burner "gun" is not in use and includes a cooling blower.

A fragmented wood-type fuel fired small scale or domestic hot water unit is illustrated in FIG. 4. In this example the hot water unit 50 utilizes an electric ignition chip wood burner 52 of the type illustrated in FIG. 2 but modified as hereafter described. The firebox 53 is elongated in the vertical direction to provide a flame path extending vertically from the combustion grate 55 of sufficient length to afford substantially complete combustion of the flue gases before passing through the heat exchange section 56 of firebox 53. Thus, in this example of the vertically elongated firebox both the primary combustion and afterburning of the products of wood fuel combustion take place along the vertical pathway 54 defined by the refractory walls 57 of firebox 53 and the refractory divider 58.

The electric igniter 60 opens into the combustion section of firebox 53 immediately adjacent and above the combustion grate 55, and includes a shroud 63 heating element 64 and blower 65 as heretofore described with reference to FIG. 2. Below the combustion grate 55 a forced air blower 67 provides the major portion of combustion air through air inlet 69 in the form of underfire air which passes through the combustion grate 55 and locus of combustion from below.

To provide some example dimensions, the vertical flame path 54 affords a combustion pathway of approximately 1-2 feet (61 cm.) prior to contact with the heat exchange surfaces of water tubing 70 in the heat exchange section 56 of the firebox 53. The electric igniter 60 is positioned approximately one-half inch (1.25 cm.) above the grate 55. The diameter of the igniter shroud 63 is two inches (5 cm.). The diameter of the outlet of blower 67 is also approximately two inches (5 cm.).

Mounted over the combustion chamber firebox 53 is the wood chip trickle feeder 80 which includes the wood chip bin 81 conveyor 82 and conveyor motor 83. One flame sensor 85 is mounted adjacent the conveyor 82 in the line of sight of flame pathway 54 and combustion grate 55 for sensing the presence of flames from wood chips accumulated on the grate. The second flame sensor 86 is positioned at the turn of the flame pathway leading to heat exchange section 56 and out of the direct line of sight to the combustion grate 55. The dual flame sensor arrangement affords the same advantages as heretofore discussed with reference to FIGS. 1 and 2.

The heat exchange coil 70 mounted in the heat exchange section 56 of the firebox 53 forms part of the water circulating system for the electric hot water storage tank 72. Cold water through the inlet 53 passes through the heat exchange coil 70 to the hot water line 74 which divides into hot water line 75 for storage in the hot water tank and the hot water outlet line 76 which is connected to the area of use. The smoke pipe 87 for the chip wood burner 52 may be provided with a draft inducer blower 88 if the natural chimney draft is insufficient.

Figure 5:
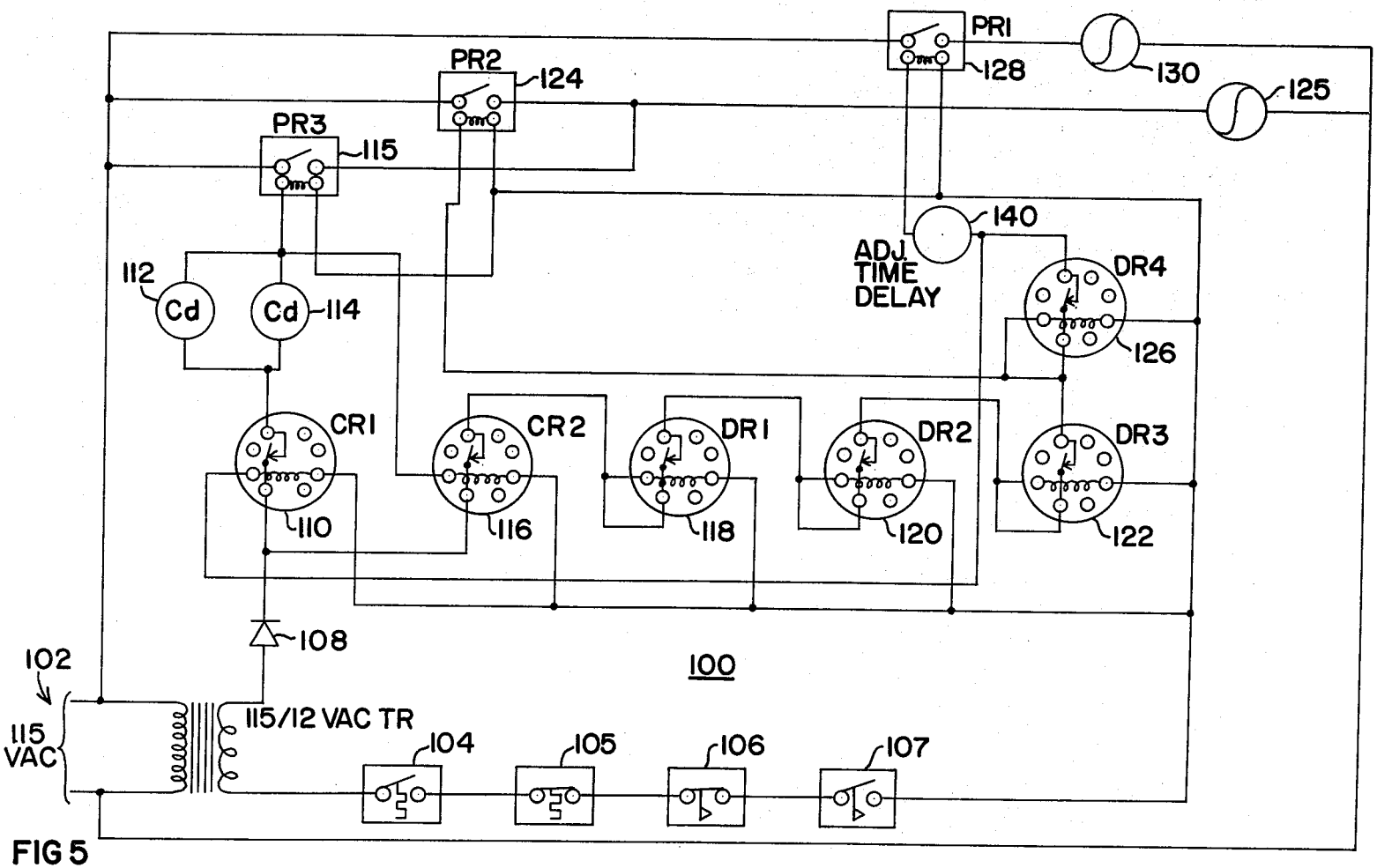
FIG. 5 is a simplified schematic diagram of a furnace control system for a furnace of the type illustrated in FIGS. 1 through 4.

One example of a control system according to the present invention for operation of the foregoing furnaces is illustrated in FIG. 5. In this example the control circuit 100 operates at 12 volts DC from the secondary of transformer 101 whose primary is coupled to the 115 volts AC line source 102. Thermostat 104 is coupled in series with the control circuit, opening when no heat is required, and closing the circuit when heat is called for. Also coupled in series with the control circuitry are safety switches 105, 106 and 107. Safety switch 105 is a thermal cutout switch mounted in the chip wood fuel conveyor over the fuel drop tube, preset to open the circuit should excessive temperatures be sensed in the conveyor. Thus, safety switch 105 shuts off the whole system should flames or combustion gases rise into the fuel supply. Safety switch 106 is a blockage switch mounted at the delivery end of the conveyor responsive to pressure from blockage of wood chips to open the circuit and switch off the whole system should the fragmented wood-type fuel become jammed in the conveyor. Safety switch 107 similarly responds to loss of draft, opening the circuit and switching off the whole system should the draft become blocked. Thus, safety switches 105, 106, and 107 are normally closed and respond to excessive temperature, fuel blockage or draft blockage to open the circuit and switch off the system.

The control circuit comprises a number of control relays CR1-CR2 and delay relays DR1-DR4 operating on 12 volt DC obtained from the 12 volts AC of the secondary of transformer 101 through rectifier 108. The control circuit also includes a number of power relays PR1-PR3 switching line voltage from the 115 volt AC line voltage source 102. If all safety switches 105, 106 and 107 are closed and the thermostat 104 calls for heat by closing the circuit, 12 volts DC is supplied through the normally closed contacts of control relay 110, designated CR1, to the parallel wired flame detectors 112 and 114. In this example, cadmium cell flame detectors are used. If the system is starting cold, no flames are detected and therefore no current is conducted by the flame detector cells 112 and 114 to the energizing coils of power relay 115 designated PR3. Additionally, control relay 116 also designated CR2 remains unenergized. Control relay 116 is normally closed and the 12 volt DC control signal through rectifier 108 is therefore applied to the interval delay relay 118 also designated DR1. When energized, the output contacts of interval delay relay 118 immediately open and remain open for a preset delay period, normally for example, 10 seconds. Upon completion of the delay period the contacts of interval delay relay 118 close and the signal is applied to delay relay 120, also designated DR2 a "delay on make" time delay relay. When the operating coil of DR2 is energized, the contacts of DR2 remain closed until the delay period is complete, normally for example, five minutes.

During this delay period while the "delay on make" time delay relay 120 remains closed, the control signal is applied to the on-off cycling time delay relay 122 also designated DR3. This relay 122 is normally set to operate alternatively two minutes on and one minute off. During the on period the control signal is applied to the operating coil of power relay 124, also designated PR2, switching on 110 volts AC line voltage to the chip wood trickle feed motor or other fragmented wood-type fuel feeder 125. The control signal from delay relay 122 is also applied to the "delay on make" relay 126, also designated DR4. When the coil of normally closed delay on make relay 126 is energized the contacts remain closed normally for a delay period of for example, one minute during which the control signal voltage is applied to the coil of power relay 128 also designated PR1, switching the 115 line voltage AC to start the igniter 130. The fragmented wood-type fuel igniter 130 may of course be an oil burner of the type illustrated with reference to FIG. 1 or preferably the electric heater igniter described with reference to FIG. 2. The control signal from delay relay 126 is also applied to the energizing coil of control relay CRl, cutting the flame detectors 112 and 114 out of the circuit whenever the igniter 130 is running.

Thus, closing the thermostat 104 results in a 10 second delay after which the chip feed 125 and igniter 130 are switched on. Following the one minute delay introduced by delay relay 126 the igniter 130 turns off and the flame detectors 112 and 114 look for a flame. If a flame is detected the coil of control relay 116 is energized opening the contacts and interrupting the ignition cycle. Another result of flame detection is that power relay 115 is closed maintaining operation of the fragmented fuel feeder or chip feed 125 through the alternate path for line voltage through power relay 115.

If flame is not detected by flame detectors 112 and 114 chip feed continues for the second minute of the two minute on-cycle of on-off cycling time delay relay 122. During the one minute off-cycle everything stops for the duration of one minute to give the wood chips or other fragmented wood-type fuel a chance to burn assuming there was successful ignition. The two minute on-cycle is then repeated giving one minute of ignition and chip feed and one minute of chip feed only.

During this cycle, if flame is detected at any time by flame detectors 112 and 114, and assuming the igniter 130 is not on, then control relay 116 is energized stopping ignition, that is cutting off line voltage to the igniter 130. At the same time power relay 115 is activated delivering line voltage to the chip wood feeder 125 and holding the chip feed on. The end of the second two minute on-cycle of on-off cycling time delay relay 122 also coincides with the completion of the delay period for example, five minutes, of the "delay on make" time delay relay 120. At this occurrence the contacts of delay relay 120 open and the cycle cannot be reinitiated without removal of the input power at line 102.

If ignition is successful the chip feeder 125 remains actuated and chip feed continues as long as the thermostat 104 calls for heat and as long as flame is detected by flame detectors 112 and 114. If for some reason there is no flame, for example due to interruption or blockage of the chip feed, power relay 115 is de-energized stopping the chip feed conveyor 125. The contacts of control relay 116 return to the normally closed position and after the 10 second interval delay on delay relay 118 the whole ignition cycle is restarted. Delay relay 118 functions to prevent "nuisance" cycling of the igniter, if the detectors failed to see flame momentarily. For example, if the detectors fail to see flame because of temporary overfeeding, reignition is delayed 10 seconds by which time the flame is normally re-established. Using the two detectors 112 and 114 in parallel similarly prevents nuisance cycling of the igniter due to one detector momentarily failing to see flame.

When the thermostat 104 is satisfied and opens the circuit the 12 volt supply is broken and all relays are de-energized, shutting off line voltage to the chip feed or fragmented wood-type fuel feeder 125 and the igniter 130. Similarly, loss of draft, blockage in the conveyor, or excessive temperatures in the conveyor switch off the whole system. The thermostat and safety switches may be wired into the line voltage supply to the transformer if desired rather than on the low voltage side as shown in the diagram of FIG. 5.

In another form of the control circuit and furnace system, a preset delay interval is established between the time the fragmented fuel feeder is actuated and the time the igniter is turned on. This time delay period during which feed of chips or other fuel fragments accumulates fuel on the grate may be for example, in the order of two minutes or over a wide range according to the output of the furnace. Thus, when a thermostat or an aquastat in the case of a boiler calls for heat a time delay relay starts the chip feed or other fragmented fuel feeder and associated auxilliaries. After the preset time, relay switches deliver power to the igniter for ignition of the bed of chips accumulated on the grate in front of the igniter aperture. At the same time that the igniter is turned on, other auxilaries such as chimney draft inducer blower, forced combustion air blower, etc. are turned on. The flame sensors are also activated as well as a second time delay switch. When flame appears in the fire box, either of the flame sensors will cause the ignition section to turn off the igniter and the second time delay switch will allow the fragmented fuel or chip wood feeder and auxiliaries to continue.

If flame does not appear within the preset second delay time interval typically one to five minutes, the second time delay switch turns off the chip wood fuel feeder and auxiliaries. The time switch must then be manually be re-set.

If flame is established but then goes out, the ignition sequence begins anew until the flame is re-established. When stable combustion is established with a dependable flame the igniter is switched off and feeding of fuel and combustion continues until the operating thermostat or aquastat shuts down the system.

If the thermostat or aquastat calls for heat while the fire box is still hot and the new fuel is ignited by the embers of the previous fire, the entire ignition sequence may be initiated. However, the ignition element will only turn on momentarily if flame is already established in the fire box.

When using the electric heater igniter according to the examples of FIG. 2 and FIG. 4 the igniter blower remains on even after the igniter heating element is switched off. This air supply keeps the igniter element cool increasing the life of the element and also supplies over fire air for more intense combustion. Of the two time delay intervals programmed into the control of the furnace or boiler system the first time interval permits accumulation of a bed of fuel on the grate prior to activation of the igniter heating element while the second time delay interval turns off the igniter and shuts down the system if ignition does not occur within the preset time of the second interval. This protects the heating element of the electric heating igniter from burn out in case of fuel supply failure or chips which are too wet, etc.

In the context of the control circuit illustrated in FIG. 5 and heretofore described, the first time delay interval to permit accumulation of a bed of fuel on a grate prior to activation of the igniter heating element 130, is implemented by the adjustable time delay or relay 140. Time delay or relay 140 may be adjustable for introducing a time delay over a range of for example one to four minutes. The particular time interval is selected by observation to permit accumulation of a sufficient bed of fuel on the grate for sustained combustion. This may vary according to the rate of operation of the chip wood or other fragmented fuel feeder, the type of fuel used, etc. The remaining elements operate as before described after the specified delay period.

Figure 6:
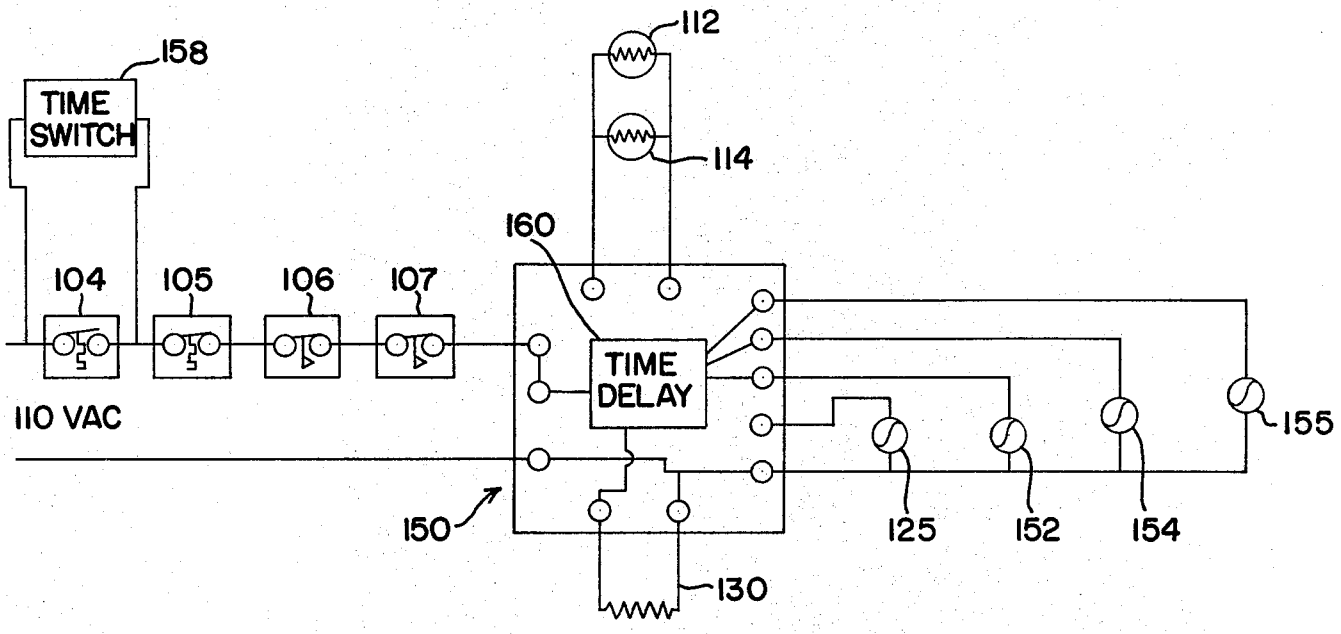
FIG. 6 is another simple schematic diagram of a control system according to the present invention applicable to the furnaces of FIGS. 1 through 4.

A more generalized schematic diagram of a control circuit 150 implementing the present invention is illustrated in FIG. 6. As heretofore described with reference to the circuit of FIG. 5 the thermostat or aquastat 104, thermal safety cutout switch 105, fragmented fuel feeder blockage cutout switch 106 and draft proving switch 107 are coupled in series with the power supply for the control circuit. In this example, however, the thermostat and safety switches 104 through 107 are coupled in the high voltage side of the power supply. Flame detectors 112 and 114 are coupled in parallel with each other to the control circuit and the igniter 130 is separately connected. The various component elements including the fragmented fuel conveyor or chip feed 125, under fire forced air fan 152, chimney induced draft fan 154, and other auxiliaries 155 associated with operation of the igniter 130 including, for example, the blower delivering air over the igniter heating element, are variously coupled in parallel to the control circuit. In addition, the adjustable time delay element 160 is shown coupled into the circuit in a manner for delaying actuation of igniter 130 during a preset period of time while fuel conveyor 125 accumulates a bed of fuel on the grate. Also coupled to the time delay with igniter 130 are the auxiliary elements such as the fans or blowers 152, 154 and 155 which operate at the same time as the igniter.

Other elements of the control circuit for example the second time delay interval turning off the igniter and shutting down the system if ignition does not occur within the preset time of the second interval are implemented for example as heretofore described with reference to the circuit of FIG. 5.

A further optional refinement of the control system is provided by a timer or interval time switch 158 which may be connected in parallel with the aquastat or thermostat 104 in the control circuit illustrated in FIG. 6. Such an interval timer switch 158 may of course also be placed in parallel with the thermostat 104 of the control circuit illustrated in FIG. 5. When the thermostat 104 is not calling for heat the timer switch 158 is operatively coupled to override the thermostat intermittently for short periods to feed sufficient fuel into the firebox to maintain a "pilot" fire. When heat is next called for by the thermostat the pilot fire affords a virtual self ignition greatly reducing the operating time and therefore increasing the life of the electric igniter or other igniter of the wood-type fuel. This standby pilot fire and the standby pilot coals which it maintains minimize temperature variations in the firebox; provide an air-rich, fuel-lean, clean burning standby condition; and eliminate cold starts during which incomplete combustion of fuel may occur.

The interval timer switch time schedule is selected to take advantage of the automatic operation of the ignition cycle effected by the control system as previously described with reference to FIGS. 5 and 6. Thus, the schedule of the timer or interval timer switch 158 may be set so that it occasionally provides a period of fuel feeding sufficiently long to carry out the full ignition cycle. This prevents unburned fuel from accumulating in the firebox if for any reason the fire is lost. A typical hourly standby routihe for implementing the solid fuel pilot fire is set forth in the following Table 1.

TABLE I

| Minutes | Condition |
|---|---|
| 0–14 | Off |
| 15 | Timer feeding fuel |
| 16–29 | Off |
| 30 | Timer feeding fuel |
| 31–44 | Off |
| 45 | Timer feeding fuel |
| 46–54 | Off |
| 55–60 | Timer feeding fuel |

The last six minutes of fuel feeding affords a sufficient time delay to build up fuel prior to ignition and allows the complete ignition cycle to take place. If the fire has been lost during the shorter intervals of the previous hour it will be reignited at this time. If ignition fails the system will shut down and remain shut down until the problem is rectified as heretofore described with reference to the full control system of FIGS. 5 and 6.

If the temperature of the heat exchanger reaches the high limit of the aquastat, or furnace bonnet control in the case of a hot air system, the timer or time interval switch 158 can either be turned off until the heat exchanger temperature descends into the operating range, or a circulater or air blower can be turned on to dissipate the excess heat. Either mode may be used successfully.

Figure 7:
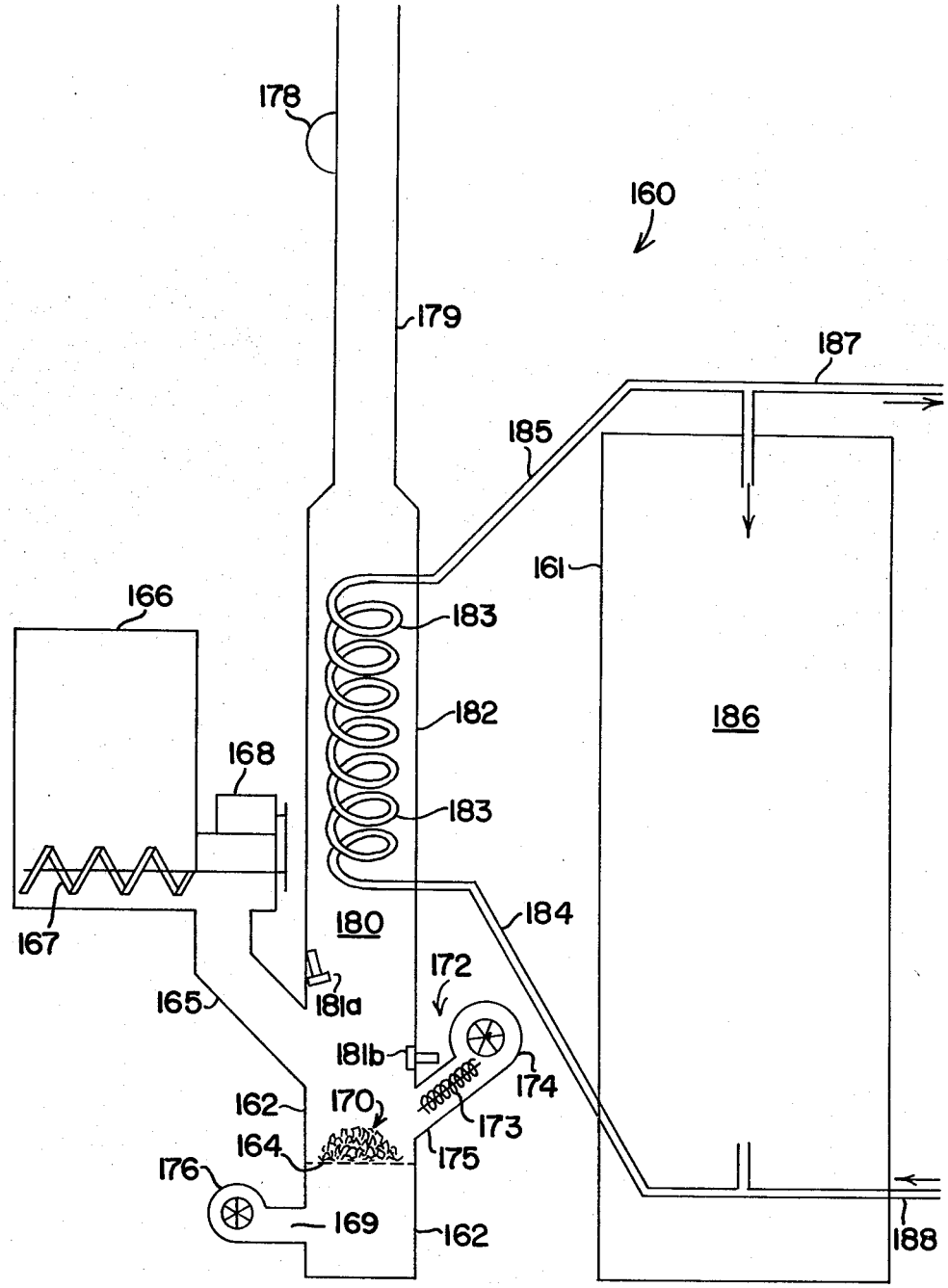
FIG. 7 is a diagrammatic view of another furnace system according to the invention with vertical flame path and heat exchange passageway, and downwardly directed or angled electric igniter.

A further embodiment of the present invention in the form of a domestic or commercial hot water heater 160 is shown in the diagrammatic view of FIG. 7. Hot water heater 161 for example, a conventional electric hot water heater, has been retrofitted in accordance with the present invention. The electric heating elements of hot water heater 161 are therefore used only for backup.

The primary source of heat energy comprises the combustion chamber 162 in which is mounted a grate 164 for receiving wood chips or other fragmented fuel delivered through chute 165 which enters the wall of combustion chamber 162 above the grate 164 at, for example a 45° slope or angle. Fuel is stored in the fuel bin 166 and delivered to the chute 165 by means an auger 167 and auger drive motor 168.

When a sufficient pile 170 of fragmented wood-type fuels has accumulated on grate 164 during a preset time interval, the electric igniter 172 is actuated including the heating element 173 and igniter blower 174. The electric igniter 172 is of the type heretofore described, however it is mounted at a position in the wall of combustion chamber 162 above the grate 164 at an angle of, for example, 35° above the horizontal so that the igniter shroud 175 is directed downward onto the pile 170 of fuel for radiating the ignition and combustion heat onto the upper surface of the pile of fuel.

A feature and advantage of the tilted or tipped electric igniter 172 is that it permits radiating onto the upper surface of the pile rather than the side and the furnace can operate for a longer period of time before it is necessary to dump or shake down the grate 164. Furthermore, a protective grid or mesh over the open end of the shroud 175 is unnecessary because the downward slope prevents fragments of fuel from entering the shroud.

Under fire air is provided through underfire air inlet 169 by a blower 176 mounted at the side of the combustion chamber below grate 164. Blower 176 delivers combustion air which passes upward through the grate in the draft induced by draft inducer blower 178 mounted in the chimney or smoke pipe 179.

In the arrangement of the invention illustrated in FIG. 7 the afterburner section or flame passageway 180 extends vertically above the combustion chamber 162. The flame passageway 180 is of sufficient length to permit substantially complete containment and dissipation of the secondary combustion flame prior to entry of the flue gas into the heat exchange section 182. The heat exchanger water coil 183 is connected in line 184 extending from the hot water heater 161 and in line 185 returning the heated water to the hot water heater tank 186 or directly into the hot water line 187. Cold water is brought in at line 188.

The flame sensors 181*a* and 181*b* are positioned in the flame passageway 180 for looking down on the grate 164 and across the passageway 180 respectively. The flame sensors are coupled into the control circuit as heretofore described.

According to other variations of the invention, instead of a single grate or combustion surface, any of the foregoing furnaces and combustion chambers may be formed with, for example, a pair of side-by-side grates. Furthermore, the flame path or afterburner section may extend vertically or horizontally from the grate and for a selected distance sufficient for the flame path. Similarly, the heat exchange sections may assume any of a number of configurations and positions downstream from the flame path or afterburner.

While the invention has been described with reference to particular example embodiments, it is intended to cover all variations and equivalents within the scope of the following claims.

The embodiments of the invention in which an exclusive property or privilege is claimed are defined as follows:

1. A furnace system comprising: wood-type fuel combustion chamber means comprising an enclosure of refractory material forming a primary combustion section and an afterburner section affording flame passageway means within said enclosure, a combustion chamber surface mounted in the primary combustion section for receiving fragments of wood-type fuel and for supporting said fuel during combustion, said enclosure formed with an opening above the combustion surface for gravity delivery of fragmented wood-type fuels onto said surface, said enclosure formed with combustion air inlet means in said primary combustion section and draft outlet means in the afterburner section, electric igniter means, said electric igniter means comprising heating element means operatively formed for achieving flash point temperatures of the fuel to be ignited, shroud means enclosing said heating element means and operatively communicating at one end with the combustion chamber means above the combustion surface and adjacent wood-type fuel supported on said surface, said shroud means open at said end to expose wood-type fuel supported on the surface to radiant heat from the heating from the heating element means for ignition by radiant heat without the heating element means contacting the wood-type fuels, said shroud means mounted at an angle above the horizontal and directed downwardly toward the combustion surface, blower means coupled to the other end of said shroud means for delivering air over the heating element means thereby cooling the heating element means and delivering heated combustion air to the wood-type fuel supported on said surface, flame sensor means positioned relative to the combustion chamber means for sensing the presence of flames from wood-type fuels supported in the combustion chamber means, said flame sensor means comprising a first flame sensor positioned relative to the wood-type fuel combustion chamber means over the combustion surface looking downwardly for sensing the presence of flames from above said surface, and a second flame sensor positioned relative to the wood-type fuel combustion chamber means at the side and looking across the flame path for sensing the presence of flames passing from the primary combustion section to the afterburner section of the combustion chamber, said first and second sensors coupled in parallel in the control circuit means for concurrent control of the electric igniter means heating element means, and control circuit means operatively coupling said heating element means and flame sensor means for switching off said heating element means upon sensing of flames from the wood-type fuel, said control circuit means comprising timing means for turning off the heating element means after a specified period of time if flames are not sensed by the flame sensor means.

2. A new and improved furnace system for automatically controlled continuous and efficient combustion of fragmented wood-type fuels such as chipped hogged, and pelletized wood, bark, wood waste, and logging residues, said furnace system adapted for utilizing and retrofitting conventional hot air, steam and hot water furnaces or boilers having a conventional combustion chamber, heat exchanger, and firing means, said new furnace system comprising:

wood-type fuel combustion chamber means formed by an enclosure of refractory material and having a combustion surface for supporting fragmented wood-type fuel for efficient combustion of the wood-type fuel at elevated temperatures, said wood-type fuel combustion chamber means comprising an enclosure of refractory material forming a primary combustion section and an after burner section within said enclosure and wherein said combustion surface is mounted in the primary combustion section for receiving the fragments of wood-type fuel and for supporting the combusting fuel, said enclosure formed with an opening over the combustion surface for gravity delivery of fragmented wood-type fuel downwardly onto said surface;

fragmented wood-type fuel feeding means for trickle feeding wood-type fuel fragments at selected uniform rates and for introducing the trickle fed fuel fragments onto the combustion surface of the wood-type fuel combustion chamber means;

flame passageway means for coupling the wood-type fuel combustion chamber means with the combustion chamber or plenum of a conventional furnace to be retrofitted;

electric igniter means for igniting wood-type fuel supported on the combustion surface, said electric igniter means comprising heating element means operatively formed for achieving flash point temperatures of the fuel to be ignited, shroud means enclosing said heat element means and operatively communicating at one end with the wood-type fuel combustion chamber means above said combustion surface adjacent wood-type fuel supported on said surface, said shroud means open at said end to expose wood-type fuels supported on the combustion surface to radiant heat from said heating element means for ignition by radiant heat without the heating element means contacting the wood-type fuels, and blower means coupled to the other end of said shroud means for delivering air over the heating element means thereby cooling the heating element means and delivering heated combustion air to the wood-type fuel;

flame sensor means positioned relative to the wood-type fuel combustion chamber means for sensing the presence of flames from wood-type fuels supported in the combustion chamber, said flame sensor means comprising a first flame sensor positioned relative to the wood-type fuel combustion chamber means over the combustion surface looking downwardly for sensing the presence of flames from above said surface, and a second flame sensor positioned relative to the wood-type fuel combustion chamber means at the side and looking across the flame path for sensing the presence of flames passing from the primary combustion section to the afterburner section of the combustion chamber, said first and second sensors coupled in parallel in the control circuit means for concurrent control of the electric igniter means heating element means;

and control circuit means for controlling and sequencing operation of the elements of the furnace system, said control circuit means operatively coupling said heating element means and flame sensor means for switching off said heating element means upon sensing flames from the wood-type fuel, said control circuit means comprising timing means for turning off the heating element means after a specified period of time if flames are not sensed by the flame sensor means.

3. The furnace system of claim 2 further comprising means for establishing a draft through the furnace system at least during start-up of the furnace system.

4. The furnace system of claim 2 wherein said wood-type fuel combustion chamber means comprises an enclosure of refractory material forming a primary combustion section and an after burner section within said enclosure and wherein said combustion surface comprises a grate mounted in the primary combustion section for receiving the fragments of wood-type fuel and for supporting the combusting fuel, said enclosure formed with an opening over the combustion surface for gravity delivery of fragmented wood-type fuel onto the grate, said enclosure also formed with underfire combustion air inlet means (69,169) at a level below said grate (55,164) so that at least a portion of combustion air passes through said combustion grate from below, said afterburner section (56,180) comprising at least a portion of the flame passageway means.

5. The furnace system of claim 4 wherein said igniter means is positioned for communicating through the wood-type fuel combustion chamber means at the primary combustion section above said grate with the shroud means at an angle above the horizontal directed downwardly toward said grate and wood-type fuel supported on said grate.

6. The furnace system of claim 4 further comprising second blower means (67,176) coupled at said underfire combustion air inlet means (69,169) for forcing combustion air through the grate (55,164) from below.

7. The furnace system of claim 2 wherein the shroud means of the electric igniter is mounted above said combustion surface at an angle above the horizontal directed downwardly toward said surface.

8. The furnace system of claim 2 wherein said wood-type fuel combustion chamber means comprises an enclosure of refractory material forming a primary combustion section and an afterburner section within said enclosure, and wherein said enclosure is also formed with additional combustion air inlet means **(31*a*) for admitting overfire air adjacent to fuel supported on the combustion surface (18*a*)**.

9. The furnace system of claim 8 wherein said igniter means is positioned for communicating through the wood-type fuel combustion chamber means at the primary combustion section above the combustion surface with the shroud means at an angle above the horizontal directed downwardly toward said surface and wood-type fuel supported on said surface.

10. The furnace system of claim 2 wherein the second flame sensor is positioned at said afterburner section for sensing flames passing from the primary combustion section to the afterburner section.

11. The furnace system of claim 2 wherein said wood-type fuel combustion chamber is elongate in the vertical direction, said vertically elongate portion comprising the afterburner section.

12. The furnace system of claim 2 in the horizontal direction, said horizontally elongate portion comprising the afterburner section.

13. The furnace system of claim 2 wherein said control system comprises pilot mode timing means for intermittently feeding fragmented wood-type fuel to maintain standby fire and coals on the combustion surface thereby enabling self-ignition by the furnace system.

14. The furnace system of claim 2 wherein said control circuit means comprises second timing means operatively coupled for delaying actuation of the electric igniter means during a specified period of time while the fragmented wood-type fuel feeding means accumulates fuel fragments on the combustion surface.

15. A new and improved furnace system for providing automatic, continuous and efficient burning of chipped, hogged, pelletized, or other fragmented wood-type fuel, said furnace system comprising:

heat exchanger means having an inlet for receiving hot combustion gases and a chimney flue outlet, said heat exchanger means constructed and arranged for transferring heat of combustion gases to a heat transfer medium;

wood-type fuel combustion chamber means formed by an enclosure of refractory material for combustion of fragmented wood-type fuel at elevated temperatures to substantially complete combustion, said enclosure formed with a primary combustion section, and an afterburner section including flame passageway means, a combustion surface positioned in the primary combustion section for receiving the fragments of wood-type fuel and for supporting the combusting fuel, said enclosure formed with an opening above the combustion surface for gravity feed of fuel onto said surface, said enclosure formed with combustion air draft inlet in the primary combustion section in the vicinity of said surface for introducing combustion air, and a draft outlet spaced from the combustion surface in the afterburner section for venting the products of combustion to the heat exchanger means;

electric igniter means for igniting wood-type fuel supported on the combustion surface, said electric ingiter means comprising heating element means operatively formed for achieving flash point temperatures of the fuel to be ignited, shroud means enclosing said heating element means and operatively communicating at one end with the combustion chamber means above the combustion surface and adjacent wood-type fuel supported on said surface, said shroud means opened at said end to expose wood-type fuel supported on the surface to radiant heat from the heating element means, and first blower means coupled to the other end of said shroud means for delivering air over the heating element means thereby cooling the heating element means and delivering heated combustion air to the wood-type fuel supported on said surface;

flame sensor means positioned relative to the combustion chamber means for sensing the presence of flames from wood-type fuel supported in the combustion chamber means;

fragmented wood-type fuel feeding means comprising conveyor means for trickle feeding fragmented wood-type fuel at selected uniform rates to a position over the wood fuel combustion chamber means and the opening over said combustion surface;

said combustion chamber means opening for gravity feed of wood-type fuel fragments from the conveyor means to the combustion surface affording at least a first break in the fuel line thereby to prevent propagation of combustion up the fuel line from the combustion chamber means into the fragmented wood-type fuel feeding means;

means for inducing a draft through the combustion chamber means and heat exchanger means at least during start-up of the furnace system;

and control circuit means for controlling and sequencing the elements of said furnace system, said control means operatively coupled to turn on the wood-type fuel feeding means and first blower means and actuate the electric igniter means for igniting wood-type fuel fragments received on the combustion grate, said control means operatively coupling said flame sensor means and heating element means for switching off said heating element means upon sensing flames from the wood-type fuel.

16. The furnace system of claim 15 wherein the control circuit means further comprises safety switch means operatively coupled for shutting down the furnace system if the igniter means fails to ignite the wood-type fuel during start-up, if mechanical blockage occurs in the fuel feeding means, if excessive temperatures occur at the fuel feeding means, or if the flue draft fails through the combustion chamber or chimney flue outlet.

17. The furnace system of claim 15 wherein said flame sensor means comprises a first flame sensor positioned relative to the combustion chamber means over the combustion surface looking downwardly for sensing the presence of flames from above said surface, and a second flame sensor positioned relative to the combustion chamber means at the side of said chamber means looking across the flame path for sensing the presence of flames from the side, said first and second sensors coupled in parallel in the control circuit means.

18. The furnace system of claim 17 wherein the second flame sensor is positioned at said afterburner section for sensing flames passing through the afterburner section.

19. The furnace system of claim 15 wherein said electric igniter means is positioned above the combustion surface at an angle above the horizontal and directed downwardly toward the surface and fuel accumulated on said surface.

20. The furnace system of claim 15 wherein said control system comprises pilot mode timing means for intermittently feeding fragmented wood-type fuel to maintain standby fire and coals on the combustion surface thereby enabling self-ignition by the furnace system.

21. The furnace system of claim 15 wherein said control circuit means comprises first timing means operatively coupled for delaying actuation of the electric igniter means during a specified period of time while the fragmented wood-type fuel feeding means accumulates fuel fragments on the combustion grate, and second timing means for turning off the electric igniter means after a specified period of time if flames are not sensed by the flame sensor means.

22. The furnace system of claim 15 wherein said wood-type fuel combustion chamber is elongated in one of the vertical and horizontal directions and wherein said elongated portion comprises the afterburner section.

* * * * *